US007140746B2

(12) United States Patent
Chen

(10) Patent No.: US 7,140,746 B2
(45) Date of Patent: Nov. 28, 2006

(54) MULTIPURPOSE ILLUMINATION DEVICE

(75) Inventor: Ching-Chung Chen, Taipei Hsien (TW)

(73) Assignee: Tseng Mei Enterprise Co., Ltd., Taipei Hsien (TW)

( * ) Notice: Subject to any disclaimer, the term of this patent is extended or adjusted under 35 U.S.C. 154(b) by 107 days.

(21) Appl. No.: 10/833,147

(22) Filed: Apr. 28, 2004

(65) Prior Publication Data

US 2005/0201092 A1 Sep. 15, 2005

(30) Foreign Application Priority Data

Mar. 10, 2004 (TW) ..... 93203582 U

(51) Int. Cl.
*F21L 4/04* (2006.01)

(52) U.S. Cl. ..... 362/199; 362/183; 362/205

(58) Field of Classification Search ..... 362/186, 362/191, 199, 183, 205, 206
See application file for complete search history.

(56) References Cited

U.S. PATENT DOCUMENTS 6,305,819 B1 * 10/2001 Chen ..... 362/186
6,857,756 B1 * 2/2005 Reiff et al. ..... 362/184

* cited by examiner

*Primary Examiner*—John Anthony Ward
(74) *Attorney, Agent, or Firm*—Troxell Law Office PLLC

(57) ABSTRACT

A multipurpose illumination device, specifically related to an illumination instrument that can be used as an electric torch, a night-light, an emergency aid or an indicator light. The device includes a column with three sections. A main section, which is a middle of the three, has a main light, a battery, circuits, a button switch and a power supply plug. An upper section located above the main section is made of transparent or semi-transparent material. A pedestal located below the main section is made of semi-transparent material.

10 Claims, 3 Drawing Sheets

MULTIPURPOSE ILLUMINATION DEVICE

FIELD OF THE INVENTION

The present invention relates to an illumination instrument, more specifically to a structure of a multipurpose illumination device.

BACKGROUND OF THE INVENTION

Generally multipurpose illumination devices include a plurality of integrated functions, such as, the functions of an electric torch, a night-light, emergency illumination (e.g., power-out indicator light), and flash (used for alarm or for asking for help). These devices include several separate bulbs that are employed for each respective function. These integrated illumination instruments have a complex structure, are very bulky, and are neither handsome nor convenient.

SUMMARY OF THE INVENTION

The subject of the present invention is to provide a structure for a multipurpose illumination device, specifically a structure that is refined, practical and easy to use.

In the present invention, the functions of the electric torch, night-light, emergency illumination and flash are integrated and arranged in an elongated object, such as a round column or a square column. The present invention includes an LED, a circuit groupware, and structure features to form a device that is portable and convenient to use.

One feature of the present invention lies in a three-section structure, wherein related interior components and operation devices are located inside a main section, illumination equipment is located inside a transparent or semitransparent upper section, and a small light is located inside a knock-down, semitransparent pedestal. The three-section structure can be transparent, translucent, or opaque.

Another feature is two elongated protrusions mounted inside the main section and cooperating with a control button to stabilize circuit plates in the main section.

Another feature is that a rechargeable battery and related components can be placed in an interior chamber formed in the main section.

A further feature is that the pedestal is a semitransparent component and has a small light located in an interior thereof.

DETAILED DESCRIPTION OF THE INVENTION

Figure 1:
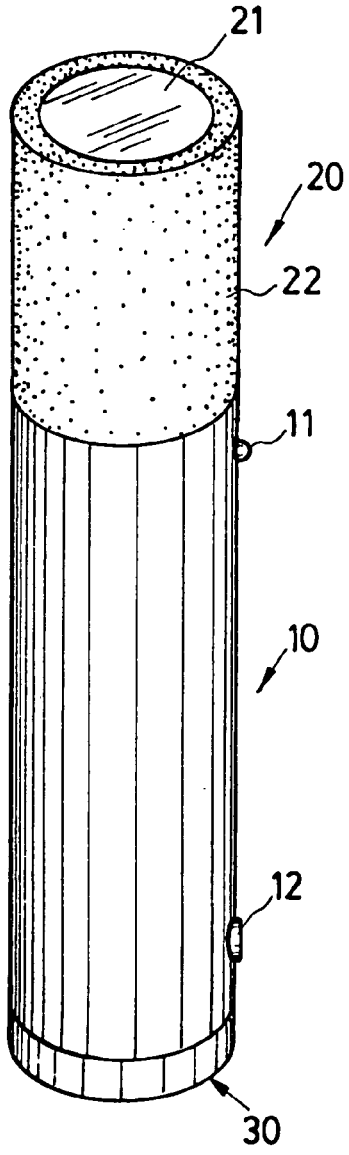
FIG. 1 is a perspective view of an embodiment of the present invention.

As shown in FIG. 1, the present invention includes a three-section structure having a main section 10, an upper section 20, and a pedestal 30.

The main section 10 is made of an opaque material and has a press-button switch 11, a power supply plug 12, and a hollow interior wherein a battery and circuit fittings are located.

The upper section 20 is made of a semi-transparent or transparent material and has a top face 21 that is transparent, and a side face of semi-transparent material that is treated to have a foggy state.

The pedestal 30 can be assembled and dis-assembled from the bottom of the main section 10, and can also be made of semi-transparent or transparent material.

Figure 2:
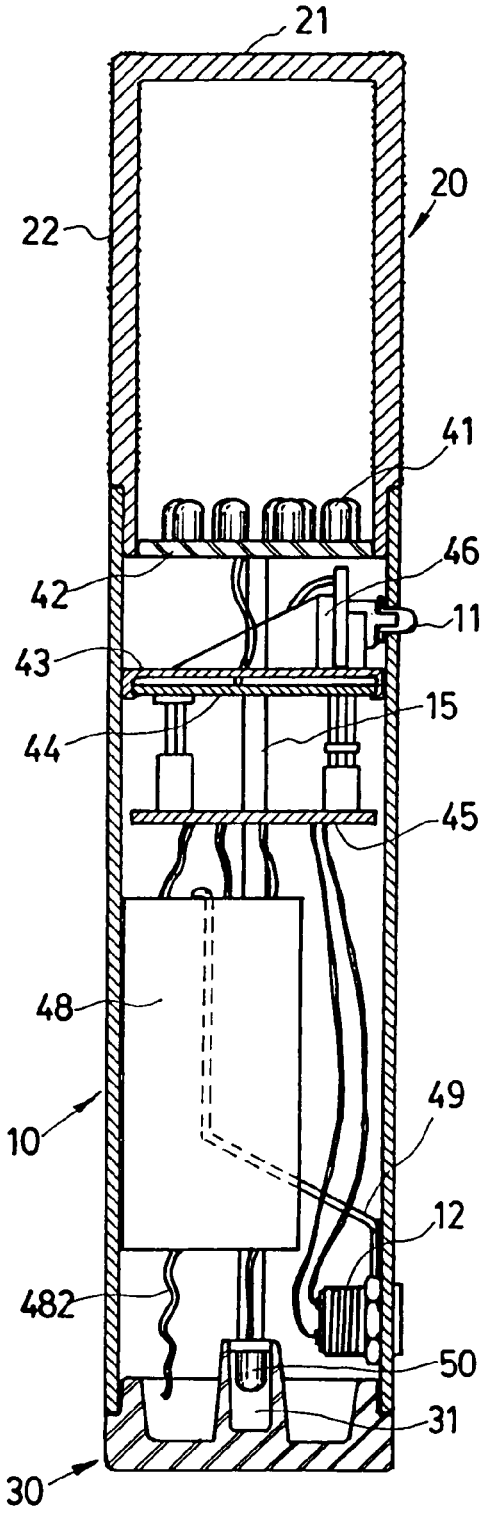
FIG. 2 is a sectional view of the embodiment of the present invention.
Figure 3:
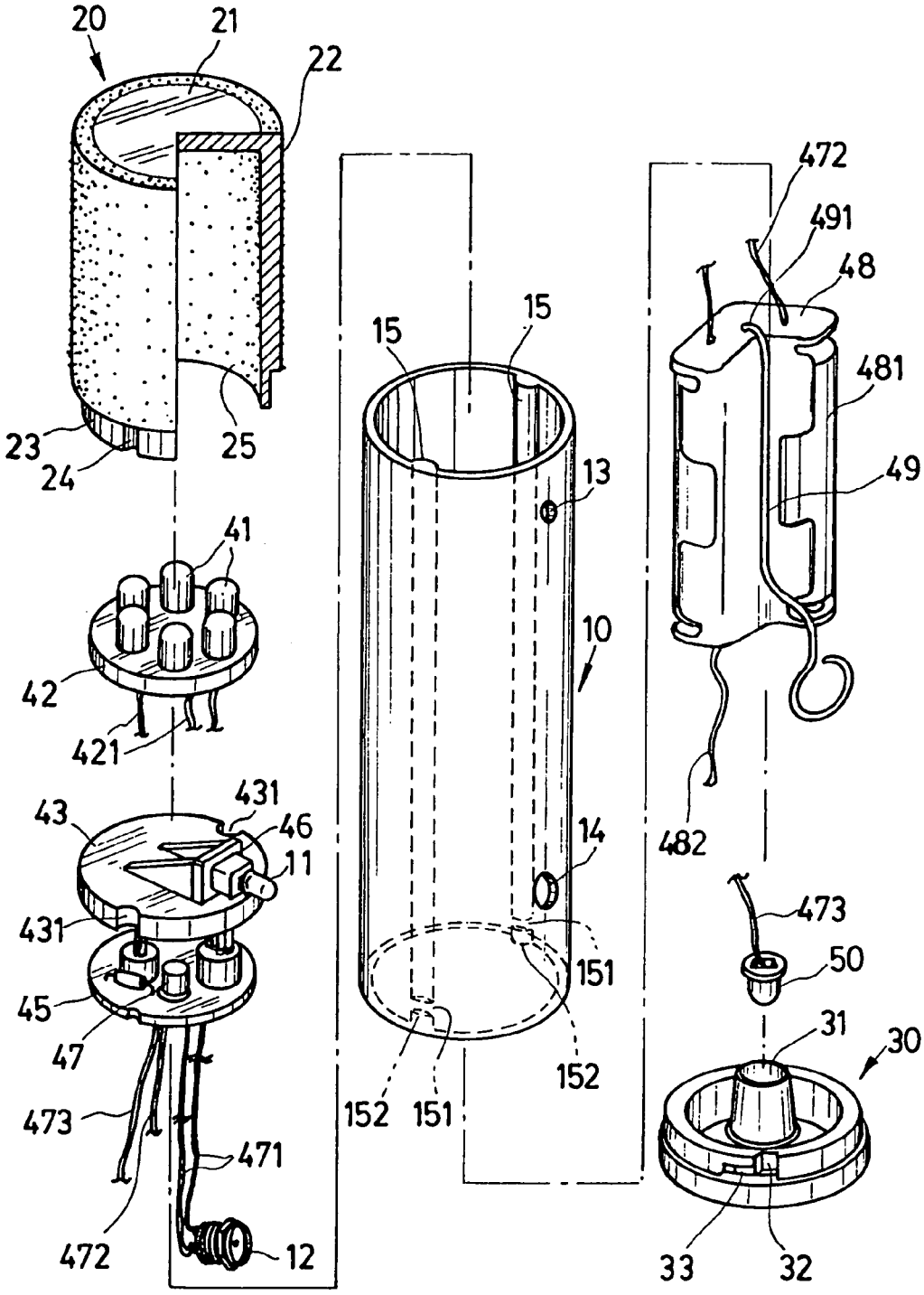
FIG. 3 is an exploded perspective view of the embodiment of the present invention.

FIGS. 2 and 3 show, respectively, an assembled and a disassembled state of inner fittings of the embodiment of the present invention, which includes a main light 41, a circuit plate 42 for the main light 41, a fixation plate 43, two circuit plates 44, 45, a switch support 46 located on the fixing plate 43, a circuit fitting 47, and a battery case 48 with a spring line 49.

The main light 41 and a first circuit plate 42 are mounted in the upper section 20, such that light from the main light 41 will radiate through the top face 21 and the side face 22 of the upper section 20 when the main light 41 is turned on.

The main section 10 is a hollow tube having holes 13, 14 and at least two elongated protrusions 15 located on an inner wall of the main section 10 and extending inwardly. The two protrusions 15 are parallel and extend along a length of the main section 10. Near a bottom of each of the protrusion 15 is a slot 151 that separates a block 152 from the end of each of the two protrusions 15.

The upper section 20 is mounted on the main section 10, as shown in FIGS. 2, 3. The upper section 20 is hollow with a top that is sealed by top face 21, and a margin 23 that has a reduced diameter with concave slots 24 on an outer periphery. The margin 23 is inserted into the interior of the main section 10, such that the protrusions 15 align with and are inserted into the slots 24.

The main section 10 and the upper section 30 can be glued or otherwise releasably fastened together. The circuit plate 42 is located in an interior 25 of the margin 23 of the upper section 20. The circuit plate 42 can be glued, or otherwise affixed in position. The circuit plate 42 has an LED main light 41 with a plurality of LEDs and electric wires 421 extending from a bottom thereof for electrical connection with the circuit plates 44, 45.

There are two recesses 431 on an outer periphery of a fixation plate 43 that is located in the main section 10. The two recesses 431 align with and accommodate the protrusions 15 to prevent rotation of the fixation plate 43 relative to the main section 10. A switch fixation pedestal 46 is located on the fixation plate 43 and is connected with a button switch 11 that protrudes out of hole 13 to fix the fixation plate 43 in the main section 10. The fixation plate 43 includes not only the switch fixation pedestal 46, but also other related components, such as a second circuit plate 44 inserted into a cavity on a bottom of the fixation plate 43 and a third circuit plate 45 connected to and located below the second circuit plate 44. Related circuit and circuit components 47 are located on the circuit plates 44, 45. Several electric wires are also connected to a bottom of the circuit plate 45, these wires include electric wire 472 connected to the battery case, electric wires 471 connected to power supply plug 12, electric wire 473 connected to a small light 50, which can be an LED. The power supply plug 12 can be connected to an external power supply.

The battery case 48 holds a battery 481, and has a pulling line 482, as well as a spring line 49 connected to the power supply plug 12 to position the battery case 48, so that the battery case 48 will not shake. The tail 491 of spring line 49 leans against the battery case 48, so that the battery case 48 will not move upward. By pulling downwards on the pulling line 482, the battery case 48 can be separated from the spring line 49 in order to remove and replace the battery 481. After replacing battery 481, the entire battery case 48 is pushed upwardly to a location where the spring line 49 contacts the battery case 48, such that the battery case 48 is anchored.

The pedestal 30 is located under the main section 10, a surface of which may be treated to be foggy or be made of semi-transparent material. The pedestal 30 has a slot 31 in a middle thereof to accommodate the small light or secondary light 50. The pedestal 30 has two grooves 32 and two slots 33 located on an outer periphery. The blocks 152 near protrusions 15 are inserted into the two grooves 32, such that, when the pedestal is rotated, the blocks 152 enter the two slots 33. Thus, the main section 10 and the pedestal 30 are removably connected.

Figure 4:
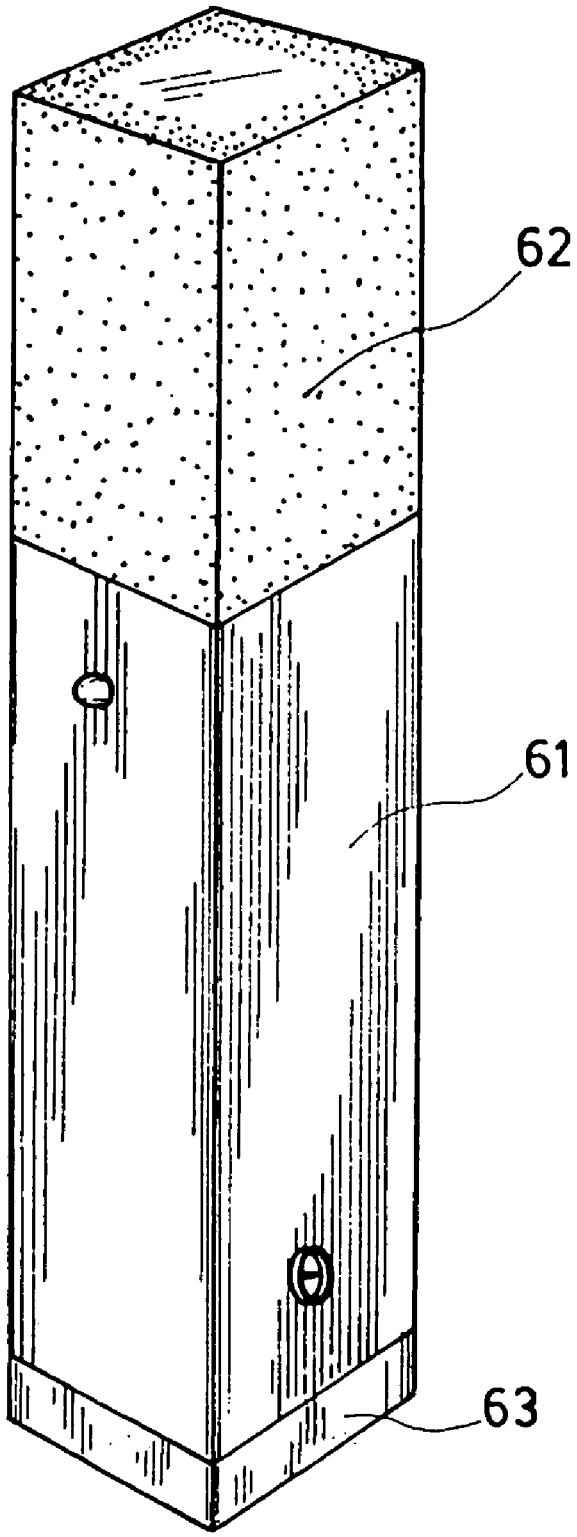
FIG. 4 is a perspective view of another embodiment of the present invention.

Another embodiment is shown in FIG. 4, wherein the three-section structure has a square cross section. The components within a main section 61, an upper section 62 and a pedestal 63 can have a circular or a square cross section, such that only the shape of the main section 61, the upper section 62, and the pedestal 63 is changed. The circular electrical components can be accommodated in the three-section structure with a square cross-section.

What is claimed is:

1. A multipurpose illumination device comprising:

a) a multiple-section structure including:

i) a hollow main section having two elongated protrusions located on an interior thereof and extending along a length thereof and extending from a first end toward a second end thereof;

ii) a hollow upper section connected to the first end of the main sections; and iii) a pedestal connected to the second end of the main section;

b) electrical components located in an interior of the multiple-section structure, wherein the electrical components include:

i) a first circuit plate;

ii) a main light connected to the first circuit plate; and iii) a second circuit plate electrically connected to the first circuit plate; and c) a button switch protruding through a first hole in the multiple-section structure, the button switch electrically connected to and controlling the electrical components and the main light.

2. The multipurpose illumination device according to claim 1, further comprising a power plug protruding through a second hole in the multiple-section structure, the power plug electrically connected to the electrical components.

3. The multipurpose illumination device according to claim 1, wherein the first circuit plate is located in the upper section.

4. The multipurpose illumination device according to claim 1, wherein the electrical components further include:

a) a third circuit plate electrically connected to the second circuit plate;

b) a secondary light electrically connected to the third circuit plate; and c) a battery case removably locate din a hollow interior of the multiple-section structure.

5. The multipurpose illumination device according to claim 4, wherein the secondary light is located in a center slot of the pedestal.

6. The multipurpose illumination device according to claim 4, wherein the second and third circuit plates are located in the main section.

7. The multipurpose illumination device according to claim 1, wherein: the upper section includes a margin portion having two concave slots; and wherein the margin portion of the upper section is inserted into the interior of the main section, such that the two protrusions are inserted into the two concave slots.

8. The multipurpose illumination device according to claim 1, further comprising: a fixation plate having two recesses in a periphery; each of the two protrusions inserted into one of the two recesses.

9. The multipurpose illumination device according to claim 8, wherein the second circuit plate and the button switch are mounted on the fixation plate.

10. The multipurpose illumination device according to claim 1, wherein each of the two protrusions having an end; two grooves extending inwardly from a periphery of the pedestal; two slots in the periphery of the pedestal, each slot extending from one of the two grooves; and two blocks extending inwardly from the main section, each block being aligned with one of the two protrusions and spaced from the ends thereof, wherein the blocks pass into the grooves and engage the slots when the pedestal and main section are rotated relative to each other so as to removably attach the pedestal to the main section.

* * * * *